US008382959B2

(12) United States Patent
Lozano

(10) Patent No.: US 8,382,959 B2
(45) Date of Patent: Feb. 26, 2013

(54) TRANSPORTABLE HYDROCARBON-RECOVERY UNIT

(75) Inventor: Servando Lozano, Bogota (CO)

(73) Assignee: M-I Drilling Fluids International B.V., Heerhugowaard (NL)

( * ) Notice: Subject to any disclaimer, the term of this patent is extended or adjusted under 35 U.S.C. 154(b) by 849 days.

(21) Appl. No.: 12/298,446

(22) PCT Filed: Feb. 15, 2007

(86) PCT No.: PCT/IB2007/050889

§ 371 (c)(1),
(2), (4) Date: Aug. 6, 2009

(87) PCT Pub. No.: WO2007/122520

PCT Pub. Date: Nov. 1, 2007

(65) Prior Publication Data

US 2010/0092355 A1 Apr. 15, 2010

(30) Foreign Application Priority Data

Apr. 25, 2006 (CO) ..... 06-38720

(51) Int. Cl.
*C10B 1/10* (2006.01)
*C10B 43/04* (2006.01)

(52) U.S. Cl. ..... 202/131; 202/241; 202/249

(58) Field of Classification Search ..... 202/117, 202/131, 136, 218, 241, 249, 265; 366/221, 366/227, 228

See application file for complete search history.

(56) References Cited

U.S. PATENT DOCUMENTS

| | | | | |
|---|---|---|---|---|
| 1,533,866 | A * | 4/1925 | Kent | 202/131 |
| 1,573,824 | A * | 2/1926 | Griffiths | 202/136 |
| 2,466,297 | A | 4/1949 | Edward et al. | |
| 4,374,704 | A * | 2/1983 | Young | 202/117 |
| 4,872,954 | A * | 10/1989 | Hogan | 202/105 |
| 5,082,534 | A * | 1/1992 | Breu | 202/131 |
| 5,927,970 | A | 7/1999 | Pate et al. | |
| 2006/0076224 | A1 * | 4/2006 | Ku | 202/99 |

FOREIGN PATENT DOCUMENTS

| | | |
|---|---|---|
| GB | 1235163 A | 6/1971 |
| GB | 2025589 A | 1/1980 |

OTHER PUBLICATIONS

International Search Report issued in PCT/IB2007/050889, mailed on Jan. 14, 2008, w/translation, 6 pages.

* cited by examiner

*Primary Examiner* — Jill Warden
*Assistant Examiner* — Joye L Woodard
(74) *Attorney, Agent, or Firm* — Osha Liang LLP

(57) ABSTRACT

This invention relates to improvements to a transportable hydrocarbon-recovery unit. More particularly, this invention relates to an integral hydrocarbon-recovery unit that comprises a first evaporation system and a condensation system. The actual first evaporation system comprises means for supplying the material to be extracted that includes means for controlling supply, means for conveying said material, treatment-chamber means including internal cleaning means, means for heating the material, means for increasing the heat-transfer area, means for removing excess material, including means for increasing hermeticity, and means for conveying the extracted vapors towards the condensation system. The purpose of the invention is to provide a unit for extracting hydrocarbons and other contaminants from impregnated material at the same time as providing, over a shorter time period and with greater effectiveness, the recovery process.

17 Claims, 2 Drawing Sheets

TRANSPORTABLE HYDROCARBON-RECOVERY UNIT

PURPOSE OF THE INVENTION

This invention relates to improvements made to a transportable hydrocarbon recovery unit. More specifically, this invention relates to an integral hydrocarbon recovery unit comprising a first evaporation [system] and a condensation system. The actual first evaporation system is comprised of means for supplying the material to be extracted that includes means for controlling supply, means for conveying said material, treatment-chamber means including internal cleaning means, means for heating the material, means for increasing the heat-transfer area, means for removing excess material, including means for increasing hermeticity, and means for conveying the extracted vapors towards the condensation system. The purpose of the invention is to provide a unit for extracting hydrocarbons and other contaminants from impregnated material, at the same time as providing, over a shorter time period and with greater effectiveness, the recovery process.

FIELD OF APPLICATION OF THE INVENTION

This invention can be used in areas of oil production, where soils or materials impregnated with hydrocarbon waste must be decontaminated. This requires the presence of the means for this work; consequently, these means must be transported to the decontamination site. The extraction means must then be effectively put to work, and their installation must be equally easy in order to begin their work. In addition, requirements of time and efficacy are more frequent, with the resulting need to improve hydrocarbon-recovery devices.

INVENTION BACKGROUND

A variety of devices are currently used to extract hydrocarbons. These current systems are formed of cylinders that rotate to move the materials as heat is introduced to complete the evaporation process. A plurality of internal chains is added to this process to direct the material towards the rear section of the cylinder, towards evacuation of the decontaminated wastes.

These chains are laid out in various sections along and around the cylinder. Said system requires that continuous maintenance be performed on these chains, and the number of chains produces unnecessary transmission loads to move the cylinder.

In addition, state of the art units refer to a configuration that does not allow the extraction of hydrocarbons from the liquids, since the configuration of the cylinder and chains provides an exclusive use for solid materials and does not allow liquid material.

In TPS (THERMAL PROCESS SOLIDS) technology, the contaminated material is carried along a duct (static housing) through the use of two helices (rotational auger), within which sufficient heat is transferred to evaporate liquids. This design of the previous art is one of the least efficient forms with reference to heat transfer; consequently great precision is required (thanks to the diversity of weights and dimensions of the materials treated) between the helices and the housing to prevent solidified material from blocking and acting as a barrier to the heat transfer between the transfer area and the material to be processed. In addition, in that same configuration, a solution is generated whose cleaning is complicated, both for the vanes of the helices as well as the housing, since there is a static system (housing) and a complex dynamic system (auger). As an example, in practice, an air film 1 mm thick can offer the same resistance to the flow of heat as a 25-mm film of water, one of iron 1.7 meters thick or copper 12 meters thick. This concept has been demonstrated and is found in different thermal literature; consequently it can be thought of as a barrier to prevent the transfer of heat from a solidified material over the transfer surface.

In addition, the above systems include gas output lines that are obstructed as a result of the accumulation of solids around the horizontal pipe that leads the vapors from the cylinder to the condensation system. These begin to form from the base of the feed screw housing.

TPS Technology, like others, also includes the need for vacuum treatment of the material. This adds risk. A Technical Consultant for the Swaco Corporation, in his report, recommended an operating vacuum no greater than 0.127 cm of water (0.05 Water Inch). This was an error, since this value is not an operating standard for the different technologies that use the same principle for evaporation, extraction and condensation. The safe and optimum vacuum handled in an evaporation chamber must have a pre-established value for each technology. This is obtained from the prior design of the system, upon theoretically and practically analyzing the pressure loss values, both static and dynamic, along same. This vacuum value should guarantee that the maximum vapor flow is evacuated, without allowing the absolute pressure at the end of the cylinder to drop below atmospheric pressure. This concept prevents safety incidents and optimizes production.

DESCRIPTION OF THE INVENTION

This invention relates to improvements to a transportable hydrocarbon-recovery unit. More specifically, this invention relates to an integral hydrocarbon-recovery unit that is comprised of an evaporation system and a condensation system. The actual first evaporation system includes a means for supplying the material to be extracted that includes means for controlling the supply, means for conveying said material, treatment-chamber means including means for internal cleaning, means for heating the material, means for increasing the heat-transfer area, means for removing excess material including means for increasing hermeticity, and means for conveying the extracted vapors towards the condensation system.

DESCRIPTION OF THE FIGURES

To further clarify the invention and its advantages compared with the known art, following is a description, with the help of the attached drawings, of possible forms of embodiment, including but not limited to the application of said principles.

PREFERABLE EMBODIMENT OF THE INVENTION

According to the invention, an integral unit of hydrocarbon recovery that includes the evaporation system is provided.

Figure 1:
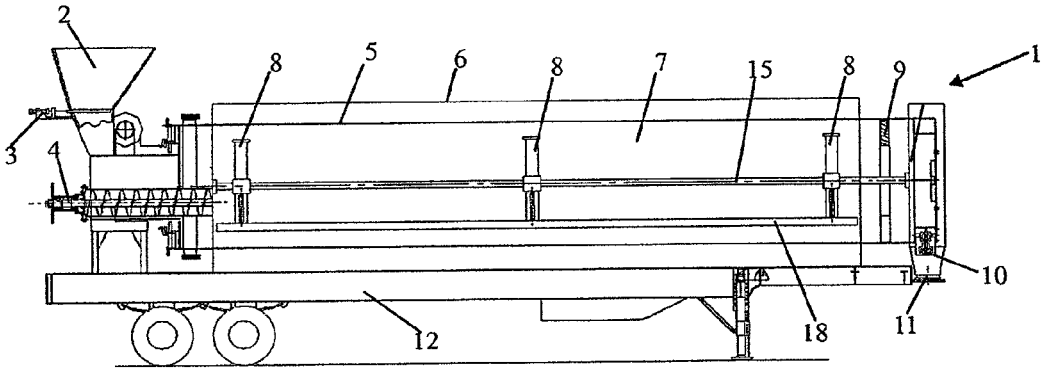
FIG. 1 illustrates a schematic view of the evaporation means of the invention unit.

As seen in FIG. 1, evaporation system 1 includes supply means 2 for the material to be extracted. In practice, these supply means can include a chute that receives the materials and also doses the material appropriately. These supply means 2 include supply control means 3.

In addition, to transfer the material for its evaporation, transportation means 4 must allow the material to be laid out horizontally. This means can include a worm or conveyor belts. FIG. 1 shows the worm modality.

From transportation means 4 the material moves to a rotary cylinder 5, isolated in an equally cylindrical structure 6. This rotary cylinder 5 must be inclined in a downstream direction, so that the liquid material is moved assisted by gravity. The cylinder inclines at an angle of between 2 and 25°, preferably between 5 and 16°.

Internally this rotary cylinder 5 holds the treatment-chamber means 7, including a plurality of internal cleaning means 8, arranged and distributed at an equal distance throughout the rotary cylinder 5.

On the other hand, rotary cylinder 5 contains means of rotation within the cylindrical structure 6. These means of rotation can include roller, pulley and belt systems or similar and can be propelled by electrical or mechanical systems.

Heating the material requires heating means. These heating means include burners or conventional heat transfer means (not shown). This heat must be sufficient to evaporate the hydrocarbons present in the material, and should be distributed along the entire rotary cylinder 5.

The invention also includes means for increasing the heat-transfer area 9. These means, with each revolution of the rotary cylinder 5, close the final trajectory of the material, accumulating it and thus increasing the heat-transfer area.

Once the material has been treated, it reaches the means used to remove excess material, which includes the means to increase hermeticity 10.

To remove the decontaminated material, the unit presents means for removing excess material. This means is a substantially internally and externally cylindrical body that includes a discharge chute 11 provided in its base. This body of the excess material removal means is subject to cylindrical structure 6, which is immobile in relation to the rotary cylinder 5.

Vapors are captured from the upper area of the rotary cylinder and are taken by ducts to a condensation system (not shown). These vapor transportation means are connected with the condensation means for processing hydrocarbon recovery.

The evaporation system is normally arranged in a way to be conveyed over a trailer structure 12 for transfer.

Figure 2:
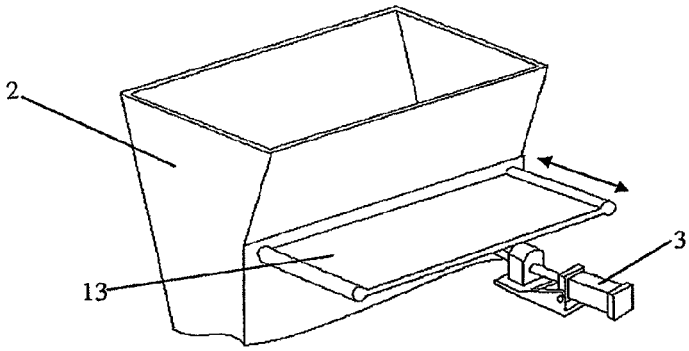
FIG. 2 corresponds to a schematic view of the means for controlling supply.

FIG. 2 shows the supply means 2 that includes supply control means 3. These supply control means 3 include a doorway 13 that leads into the supply chute 2, opening or closing the way for the material. This gate is driven by pneumatic, hydraulic or similar means, thus regulating the passage of the material to be treated.

Figure 3:
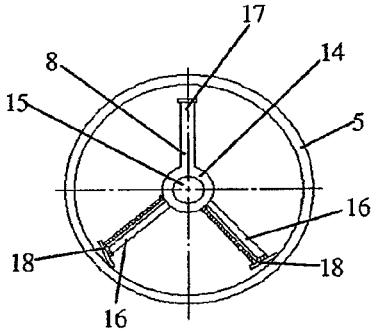
FIG. 3 corresponds to a schematic view of the means for internally cleaning the cylinder.

FIG. 3 shows the internal cleaning means 8. These internal cleaning means 8 are laid out and distributed at equal distances along the length of the rotary cylinder 5, as seen in FIG. 1. These cleaning means 8 include a central bushing 14 that receives a central axle 15 arranged along the length of the rotary cylinder 5. The central axle 15 turns in tandem with this rotary cylinder 5. Three radial and opposite arms project from this central bushing 14, the two lower arms are scrapers 16 and the upper arm is for balance 17, distributed along the circumference in the direction of the internal walls of the cylinder. Each arm is of equal weight, so that even when the rotary cylinder 5 turns in tandem with the central axle 15, the central bushing 14 does not turn, keeping the internal cleaning means 8 relatively immobile.

In this way, the cleaning means 8 are kept immobile and suspended in the central axle 15, which is laid along the length of the rotary cylinder 5.

The lower scraper arms 16 end in a cleaning plate 18, which is supported over an axle. This cleaning plate 18 scrapes the wall of the cylinder, guaranteeing that the material does not adhere to the internal wall of the cylinder. The arm can also have a spring mechanism to make this plate 18 more rigid. Each plate is arranged on each arm in such a way that the scraping profile is congruent with the turn of the cylinder.

The upper arm used for balance 17, for its part, provides the harmony necessary to make these cleaning means 8 relatively immobile.

Figure 4:
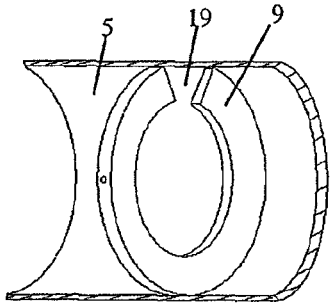
FIG. 4 corresponds to an isometric view of the means for increasing the heat-transfer area in a first situation.
Figure 5:
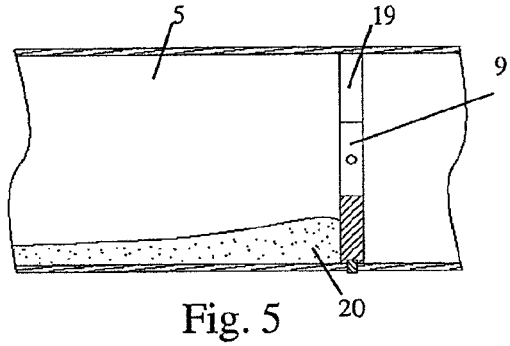
FIG. 5 corresponds to a lateral view of FIG. 4 of the means for increasing the heat-transfer area in a first situation.
Figure 6:
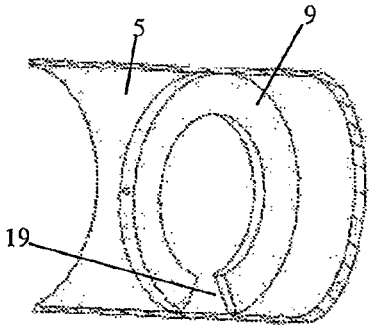
FIG. 6 corresponds to an isometric view of the means for increasing the heat-transfer area in a second situation.
Figure 7:
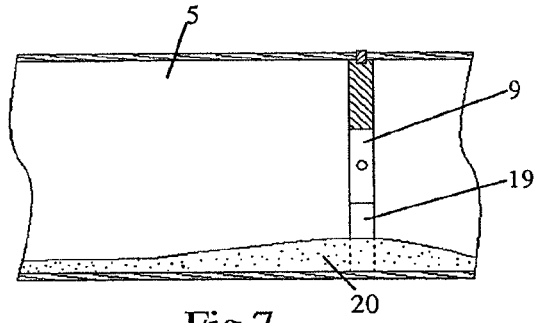
FIG. 7 corresponds to a lateral view of FIG. 6 of the means for increasing the heat-transfer area in a second situation.

As seen in FIG. 4, the invention also includes means for increasing the heat-transfer area 9, located in the final section of the cylinder. These means for increasing the heat-transfer area 9 include a rigid ring incorporated into the rotary cylinder 5, which has a window 19 so that as it turns with the rotary cylinder 5, it opens and closes the passageway for material with each revolution. As seen in FIG. 5, when the window is face up, the material 20 is accumulated by the restricted passage located in the lower part of the cylinder. As seen in FIGS. 6 and 7, when the window is face down it opens the material passageway 20 and consequently the material flows. For each revolution of the rotary cylinder 5, the material is accumulated and thus the heat-transfer area increases, guaranteeing that the material is overheated and the missing waste evaporated.

Once the material has been treated, it arrives at the means used to remove the excess material, which includes hermeticity increase means 10.

Figure 8:
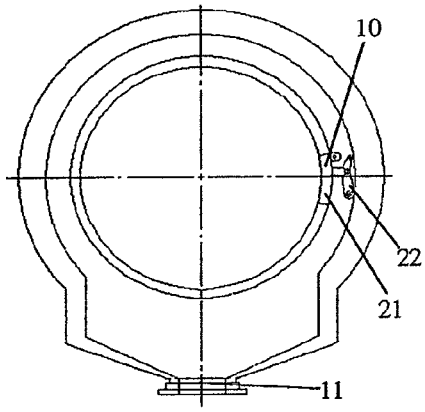
FIG. 8 corresponds to a schematic view of the means for increasing hermeticity in a first situation.
Figure 9:
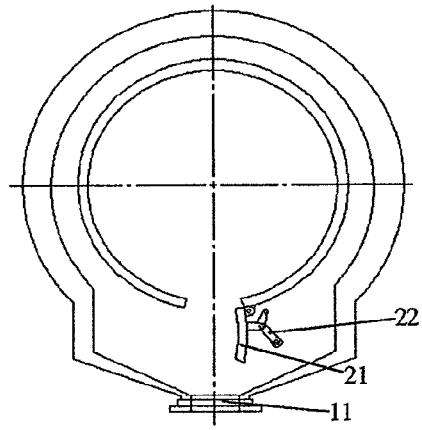
FIG. 9 corresponds to a schematic view of the means for increasing hermeticity in a second situation.

As seen in FIGS. 8 and 9, these means used to increase hermeticity 10 include a rotary doorway 21 with opening and closing means 22 associated with the internal wall of the cylindrical structure of the excess material removal means. These hermeticity increase means 10 rotate along with the rotary cylinder 5.

The opening and closing means 22 include a skid that rolls over the internal cylindrical wall of the body of the excess material removal means, where said body of excess material removal means remains immobile in relation to the rotary cylinder 5. In this way, said skid travels the internal wall and as it passes the discharge chute 11 of the excess material removal means, said rotary doorway 21 opens by gravity, discharging the excess material in connection with the discharge chute 11 and as it passes this discharge chute 11, the skid retakes the internal wall of the body of the removal means, closing the rotary doorway 21.

FIG. 8 shows doorway 21 closed and turning in the direction of discharge chute 11, so that in FIG. 9, when it connects with chute 11, this doorway 21 opens and discharges the material. This guarantees hermeticity during the evaporation process.

On the other hand the vapors are captured from the upper area of the rotary cylinder and led through ducts towards a condensation system, for the hydrocarbon recovery process.

The condensation process can include a conventional condensation system, with suction and transfer means that suction the vapors from the rotary cylinder and send them to the heat transfer means where the heat of these vapors is extracted by cooling means for later condensation and storage in the condensate reception tank.

The invention claimed is:

1. A transportable hydrocarbon-recovery unit formed of an evaporation system and a condensation system, the evaporation system comprising:

means for supplying a material;

means for conveying the material;

an inclined rotary cylinder isolated in a cylindrical structure;

means for rotating the rotary cylinder within the cylindrical structure;

means for heating the rotary cylinder; and means for removing an excess of the material, wherein said evaporation system is arranged over a trailer structure so that it can be moved;

the means of supplying material including means of controlling a supply of the material; and said inclined rotary cylinder including internal treatment-chamber means, which includes:

a plurality of internal cleaning means, arranged and distributed at equal distances along a length of the rotary cylinder;

means for increasing a heat-transfer area of the material, which open and close once for each revolution of the rotary cylinder, to accumulate material and increase the heat-transfer area; and wherein the means for removing excess material includes a body that is substantially cylindrical inside and out and with a discharge chute, and which includes means for increasing hermeticity, with a rotary doorway with associated means for opening and closing same, which opens once for each revolution.

2. The transportable hydrocarbon-recovery unit of claim 1, wherein the supply control means has a doorway that enters a supply chute, closing or opening to allow material to enter.

3. The transportable hydrocarbon-recovery unit of claim 2, wherein the doorway of the supply control means is driven by pneumatic, hydraulic or similar means.

4. The transportable hydrocarbon-recovery unit of claim 1, wherein the internal cleaning means includes a central bushing that receives a central axle that covers the length of the rotary cylinder.

5. The transportable hydrocarbon-recovery unit of claim 4, wherein the central axle rotates in tandem with the rotary cylinder.

6. The transportable hydrocarbon-recovery unit of claim 5, wherein the central bushing projects three arms in radial and opposite directions, two below, which are scrapers and one above for balance, distributed circumferentially in the direction of the internal walls of the cylinder.

7. The transportable hydrocarbon-recovery unit of claim 6, wherein the weight of each arm is equal.

8. The transportable hydrocarbon-recovery unit of claim 6, wherein the lower scraper arms end in a cleaning plate supported over an axle.

9. The transportable hydrocarbon-recovery unit of claim 8, wherein the cleaning plate runs the length of the rotary cylinder associating each lower arm to each of the internal cleaning means.

10. The transportable hydrocarbon-recovery unit of claim 9, wherein said cleaning plate is placed so that it scrapes the wall of the rotary cylinder.

11. The transportable hydrocarbon-recovery unit of claim 10, wherein the scraper arm has a spring mechanism to fasten said plate in place.

12. The transportable hydrocarbon-recovery unit of claim 11, wherein each plate is arranged in each lower scraper arm so that the scraping profile is congruent with the rotation of the rotary cylinder.

13. The transportable hydrocarbon-recovery unit of claim 12, wherein the upper balance arm provides the harmony necessary to make the said cleaning means relatively immobile.

14. The transportable hydrocarbon-recovery unit of claim 1, wherein the means for increasing the heat-transfer area include a rigid ring incorporated to the rotary cylinder, with a window so that as it turns with the rotary cylinder, it opens and closes, allowing the passage of material with each revolution; as such, when the window is face down, it opens, allowing accumulated material to pass and consequently, the material flows.

15. The transportable hydrocarbon-recovery unit of claim 1, wherein the means for increasing hermeticity include:

a rotary doorway with means for opening and closing associated with the internal wall of the cylindrical structure of the excess material removal means, wherein the means for increasing hermeticity turn in tandem with the rotary cylinder; and the opening and closing means include a skid that rolls over the cylindrical internal wall of the body of the excess material removal means, while the body of the excess material removal means is kept relatively immobile in relation to the rotary cylinder.

16. The transportable hydrocarbon-recovery unit of claim 1, wherein the vapors from the upper area of the rotary cylinder are captured and led by ducts to the condensation system to undergo the hydrocarbon recovery process.

17. A transportable hydrocarbon-recovery unit formed of an evaporation system and a condensation system, the evaporation system comprising:

a supply chute configured to receive material and supply the material to the transportable hydrocarbon-recovery unit, wherein the supply chute further includes a movable gate configured to open and close to control supply of material through the supply chute;

a conveyor configured to transfer the material from the supply chute;

an inclined rotary cylinder isolated in a cylindrical structure, wherein the rotary cylinder is configured to rotate within the cylindrical structure, the inclined rotary cylinder including an internal treatment-chamber cleaning mechanism having a central axle arranged along a length of the rotary cylinder, at least one scraper arm projecting radially from the central axle, and at least one balance arm projecting radially from the central axle;

a burner configured to heat the inclined rotary cylinder;

a rotatable ring incorporated into the rotary cylinder and having a window which opens and closes a passageway for material with each revolution, wherein material accumulates and heat transfer area of the material increases; and a discharge chute configured to remove excess material from the transportable hydrocarbon-recovery unit, the discharge chute including a rotary doorway configured to open and close in association with an internal wall of the cylindrical structure, wherein hermeticity of the material is increased.

* * * * *